United States Patent [19]

Herbig et al.

[11] Patent Number: 4,642,652

[45] Date of Patent: Feb. 10, 1987

[54] UNFOLDABLE ANTENNA REFLECTOR

[75] Inventors: Henning Herbig, Holzkirchen; Horst Heinze, Westerham; Franz Drachenberg, Baldham, all of Fed. Rep. of Germany; Knud Pontoppidan, Copenhagen, Denmark

[73] Assignee: Messerschmitt-Boelkow-Blohm Gesellschaft mit beschraenkter Haftung, Munich, Fed. Rep. of Germany

[21] Appl. No.: 664,043

[22] Filed: Oct. 23, 1984

[30] Foreign Application Priority Data

Oct. 27, 1983 [DE] Fed. Rep. of Germany ..... 3338937

[51] Int. Cl.[4] ..... H01Q 15/20

[52] U.S. Cl. ..... 343/915

[58] Field of Search ..... 343/912–915, 343/840, DIG. 2

[56] References Cited

U.S. PATENT DOCUMENTS

| | | | |
|---|---|---|---|
| 3,105,969 | 10/1963 | Banche et al. | 343/915 |
| 3,360,798 | 12/1967 | Webb | 343/915 |
| 4,030,103 | 6/1977 | Campbell | 343/915 |

OTHER PUBLICATIONS

Microwaves, Mar. 1974, p. 14.

*Primary Examiner*—Eli Lieberman

*Attorney, Agent, or Firm*—W. G. Fasse; D. H. Kane, Jr.

[57] ABSTRACT

An umbrella type unfoldable antenna reflector net is supported by carrier ribs extending radially from a carrier body and by auxiliary ribs extending between adjacent carrier ribs. Bracing wires are connected between the carrier ribs and the auxiliary ribs. The tension of the bracing wires, which in the unfolded state of the reflector net extend substantially in the direction of chords, is adjustable by respective adjustment members so that the bracing tension force has a force component which extends substantially perpendicularly to a plane defined by the unfolded reflector net. The adjustment members permit adjusting the reflector net into a parabolic shape.

11 Claims, 9 Drawing Figures

UNFOLDABLE ANTENNA REFLECTOR

FIELD OF THE INVENTION

The invention relates to an unfoldable antenna reflector, especially a metallic net reflector provided with a number of carrier ribs, especially rigid carrier ribs operatively secured to a carrier body in a pivoting or journalling manner so that the carrier ribs may be tilted outwardly during the unfolding to extend substantially radially upon completion of the unfolding operation. These carrier ribs support the metallic reflector net.

DESCRIPTION OF THE PRIOR ART

A net reflector for such an antenna as mentioned above is primarily used in satellites. An antenna of this type is shown in "Microwaves" Mar. 1974, page 14. This known net reflector comprises in addition to the reflector net proper a further adjusting net. The reflector net proper is secured to the upper side of the pivotable carrier ribs while the adjusting net is attached to the back side of the carrier ribs. The adjusting net is connected to the reflector net in the sectors between the radially outwardly pivoted carrier ribs by a substantial, large number of adjustable tensioning or bracing wires. It is the purpose of these adjustable bracing wires to make sure that the reflector net assumes in its unfolded state the desired parabolic shape as precisely as possible, even in the sectors between the carrier ribs which determine said parabolic shape. However, the adjustment of the large number of tensioning wires requires a substantial work effort, especially also because the adjustment of one wire has an effect on the neighboring or adjacent adjustment points so that repeated readjustments are necessary. These difficulties can be reduced as the number of carrier ribs employed is increased, whereby these carrier ribs must be of rigid construction to provide a defined parabolic shape.

OBJECTS OF THE INVENTION

In view of the above it is the aim of the invention to achieve the following objects singly or in combination:

to construct an unfoldable antenna netting reflector of the type mentioned above in such a manner that the effort and expenditure for the adjustment of the desired parabolic shape of the reflector net is optimally reduced;

to provide a support structure for the antenna reflector net which itself already causes the reflector net to assume a uniform curvature substantially approximating the desired parabolic shape;

to employ auxiliary ribs which help in causing the reflector net to assume the desired uniform curvature while at the same time permitting reducing the number of the relatively heavy carrier ribs;

to increase the total number of ribs used to thereby also improve the radiation characteristics of the antenna reflector; and to substantially reduce the influence of temperature changes on the shape and radiation characteristics of the antenna reflector.

SUMMARY OF THE INVENTION

According to the invention the above mentioned antenna reflector comprises one or several auxiliary ribs secured to the reflector net and located radially between the adjacent carrier ribs. These auxiliary ribs are secured to the adjacent carrier ribs by means of adjustable bracing or tensioning wires. These adjustable bracing wires may be so tensioned that the bracing wires have a force component which extends substantially perpendicularly relative to the plane which is defined by the reflector net in its unfolded condition. Stated differently, the bracing or tensioning wires extend along a force resultant, the components of which extend substantially perpendicularly to the plane of the reflector net and substantially in parallel thereto. The auxiliary ribs, which are attached to the reflector net in the sectors between the carrier ribs, make sure that the reflector net assumes at least in the zones of these auxiliary ribs a continuous or uniform curvature right from the start when the net reflector is unfolded. This initial shaping of the reflector net by the auxiliary ribs is due to the fact that a point to point adjustment with the aid of individual tensioning wires which in the prior art used to cause depressions in the reflector net, has been avoided according to the invention.

According to the invention it is possible to use a substantially smaller number of bracing wires between the auxiliary ribs and the carrier ribs than has been possible heretofore in the conventional construction of a reflector with a reflecting net proper and an adjusting net. The lower number of bracing or tensioning wires is possible according to the invention due to the cross component or rather, due to the force component extending perpendicularly to the plane defined by the reflector net because such force component is capable to apply a rearwardly directed tension to the auxiliary ribs, whereby such tension achieves a good approximation of the shape of the auxiliary ribs to the desired parabolic form. Further, additional adjusting points are not necessary between the auxiliary ribs and the carrier ribs, nor are such points necessary between the auxiliary ribs themselves. Accordingly, it is possible to substantially reduce the entire investment heretofore required for the ajustment effort. Yet another advantage is seen in that the number of the relatively heavy carrier ribs has been reduced which has an advantageous effect on the overall weight of satellites carrying such antennas. On the other hand, the total number of ribs used can be increased by using the auxiliary ribs which has the added advantage that the radiation characteristics of the antenna have been improved. For example, the position and number of the side lobes of the antenna characteristic which occur in addition to the main lobe in the antenna characteristic or radiation diagram depends on how many ribs are used altogether. The more parabolically shaped ribs are used in the antenna reflector, the further outwardly will the side lobes be shifted. Thus, the antenna net reflector according to the invention constitutes a simple and economical concept which is advantageously usable in many instances.

Another advantage of the invention is seen in that the temperature changes to which the present antenna may be exposed have a smaller influence on the antenna characteristic because the bracing wires are now secured to the carrier ribs which are relatively stable in a thermal sense. Heretofore, temperature changes were effective on the adjusting net which was thus exposed to thermally caused contractions and/or expansions, whereby the adjusting precision was impaired. The invention has avoided this problem. Yet another advantage of the adjustment according to the invention is seen in that a displacement of any adjustment point has a much smaller cross effect on any of the neighboring adjustment points than was the case heretofore in an antenna comprising the above mentioned conventional double net concept.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1A:
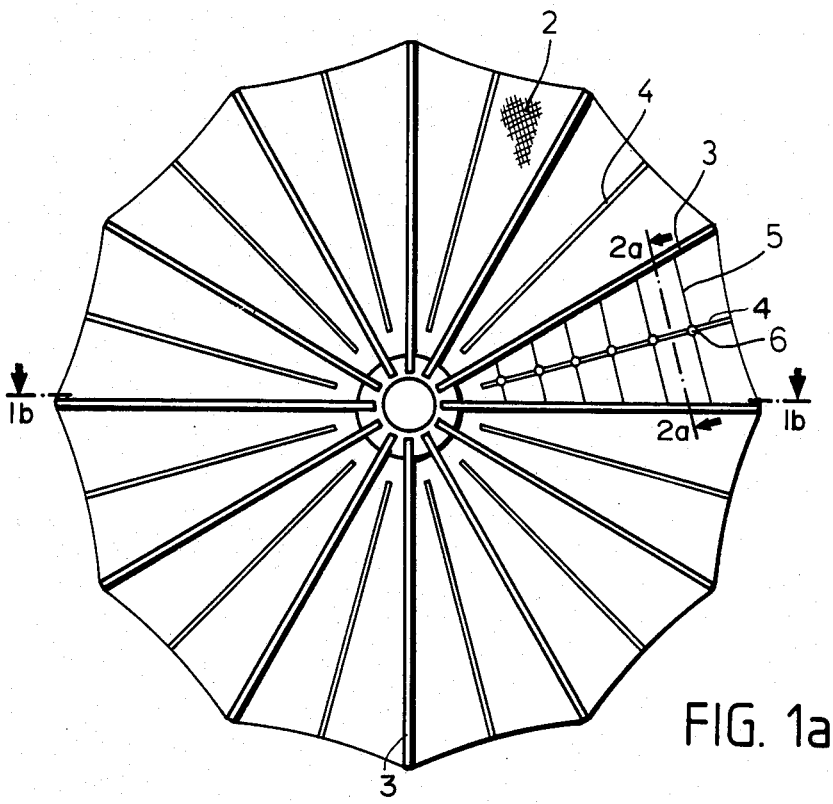
FIG. 1*a* is a plan view in the direction of the central axis of the antenna reflector and into the open reflector, whereby the central axis extends perpendicularly to the plane of the drawing.
Figure 1B:
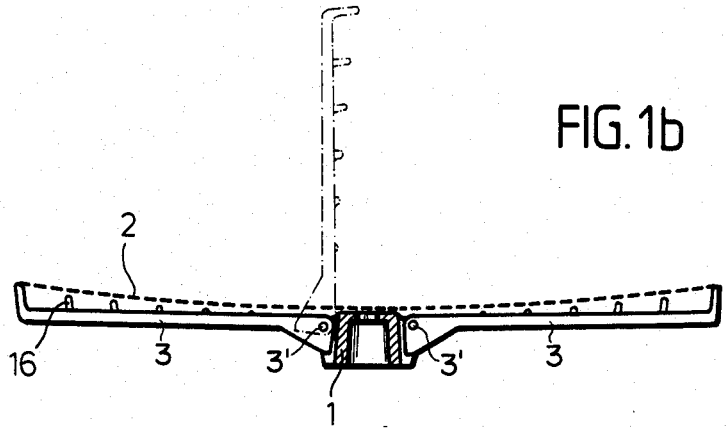
FIG. 1*b* is a sectional view substantially along section line 1*b*—1*b* in FIG. 1*a;*

FIG. 1*a* shows an antenna reflector according to the invention in its unfolded condition comprising, for example, a total of twelve carrier ribs 3 and twelve auxiliary ribs 4 located in the sectors between adjacent carrier ribs. The radially inner ends are pivotally secured by journals or hinges 3' to a carrier body or hub 1 as shown in FIG. 1*b,* whereby the carrier ribs 3 may be folded into the folded state as shown by dash-dotted lines in FIG. 1*b.* The carrier ribs 3 are equipped with spacer elements 16 shown in FIG. 1*b* to which the reflector net 2 is secured to assume a parabolic shape. The spacer members increase in size radially outwardly so that the shape of the net 2 assumes the form of a rotational paraboloid as closely as possible. Preferably, the spacer elements 16 are adjustable.

The net 2 is made of metal wire or metallized threads such as synthetic material forming a net type webbing. The mesh size of the net or webbing is selected with due regard to the wavelength to be radiated by the antenna.

The material for making the carrier ribs 3 should be so selected that these ribs 3 have a high stiffness of their own while simultaneously being as lightweight as possible. It has been found that fiber reinforced synthetic materials are well suitable for the present purposes.

The auxiliary ribs 4 are not secured to the hub 1, rather, the auxiliary ribs 4 are secured to the reflector net 2, preferably to the upper side thereof, whereby these ribs may be glued or sewn to the reflector net. Tensioning or bracing wires 5 are secured to the auxiliary ribs 4 at one end of the wires by adjustable anchoring means 6 to be described in more detail below with reference to FIG. 3. The other end of the tensioning or bracing wires 5 is connected to the carrier rib as shown at 5' in FIG. 2*a.* The wires 5 and the adjustable anchoring means 6 are located behind the antenna reflector net 2. The anchoring means 6 are accessible from the backside of the reflector net for their adjustment in order to bring the auxiliary ribs into the desired parabolic shape. For this purpose the auxiliary ribs 4 have a certain flexibility. However, it is possible to preshape the auxiliary ribs 4 so that they have an inherent stiffness conforming to the parabolic shape, whereby said adjusting means may not be necessary at all or substantially simpler adjusting means could be employed.

Figure 2A:
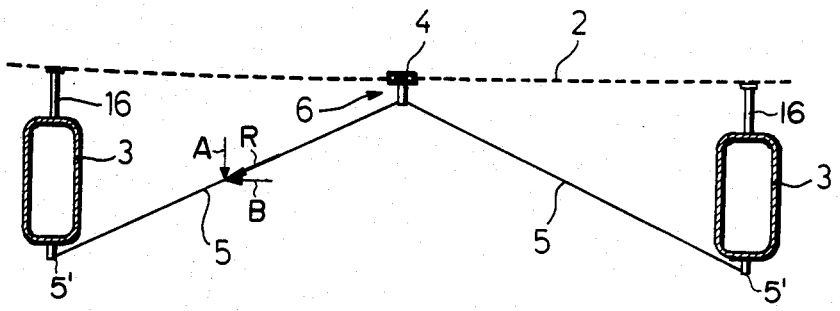
FIG. 2*a* is a sectional view substantially along section line 2*a*—2*a* in FIG. 1*a*, whereby a single auxiliary rib is located between two adjacent carrier ribs.

FIG. 2*a* shows two carrier ribs 3 and a single auxiliary rib 4 arranged centrally between the two carrier ribs with only a pair bracing wires 5 interconnecting the carrier ribs 3 with the auxiliary rib 4. The carrier ribs 4 are, for example, cut from tubular stock having, again as an example, a rectangular cross-sectional shape. The net 2 is secured to the carrier rib 3 by the above mentioned spacer members 16 which shape the net 2 into the desired parabolic form at least in a first approximation which is then improved upon by the adjustment of the wires 5 and thus of the curvature of the auxiliary ribs 4. Suitably, the auxiliary ribs 4 are attached to the outwardly facing surface of the reflector net 2. The above mentioned anchoring means 6 are secured to the backside, whereby the wires 5 are so oriented that they extend in the direction of a resultant R indicated by an arrow head in one of the wires 5 in FIG. 2*a.* The resultant R has two force components A and B which are so oriented that the cross component A extends substantially perpendicularly to a plane defined by the net 2 while the component B extends substantially in parallel to the plane defined by the net 2. The direction of these force components A and B is such that the pull required for the adjustment of the auxiliary ribs 4 in the downward direction, that is rearwardly of the net 2, is provided. It has been found that fibers of quartz are suitable for making the bracing or tensioning wires 5.

Figure 2B:
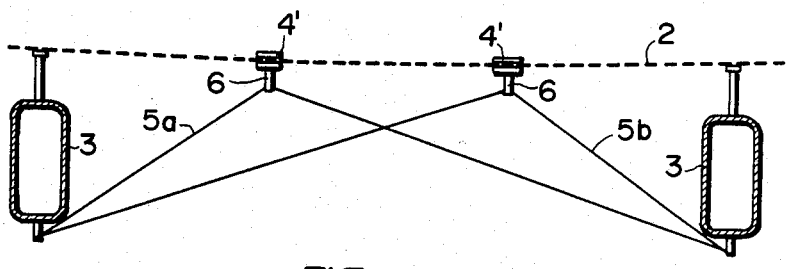
FIG. 2*b* is a sectional view substantially similar to that of FIG. 2*a,* however, showing two auxiliary ribs located between two carrier ribs.
Figure 2C:
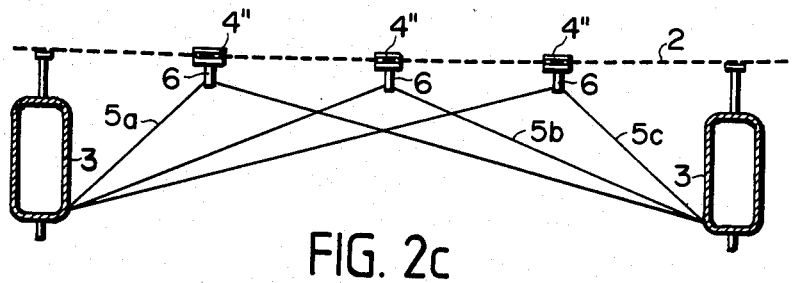
FIG. 2*c* is a sectional view similar to that of FIGS. 2*a* or 2*b,* but showing three auxiliary ribs between two carrier ribs.
Figure 3:
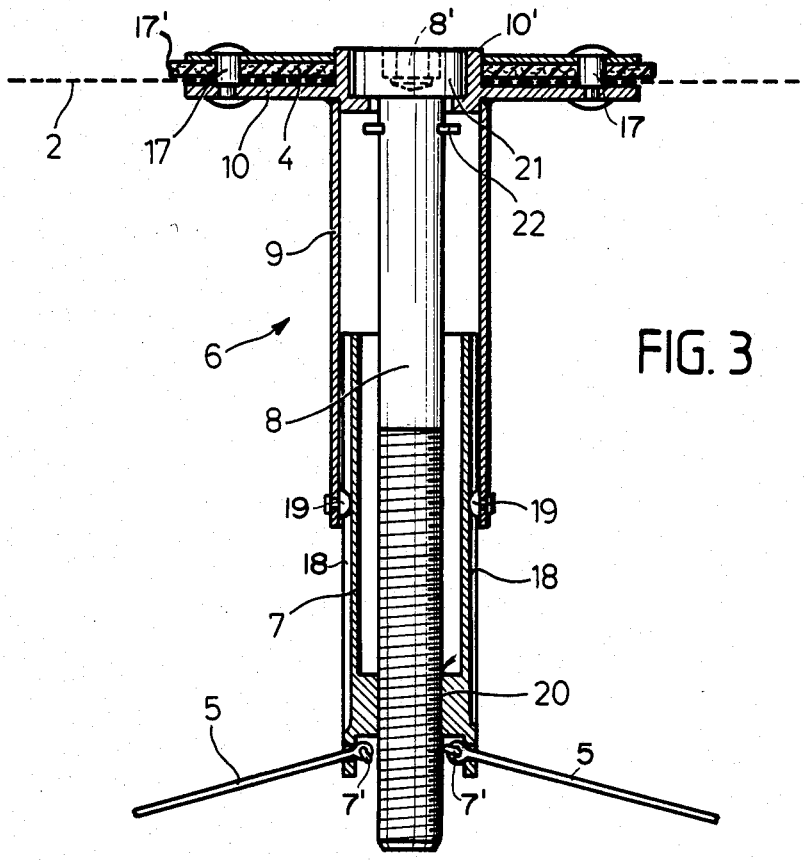
FIG. 3 is a sectional view on an enlarged scale through an adjustable anchoring device for connecting the bracing wires to an auxiliary rib.

FIG. 3 shows one possible example embodiment of an adjustable anchoring means 6 as used in FIGS. 2*a*, 2*b,* and 2*c* for connecting the wires 5 to the auxiliary rib 4 in FIG. 2*a* and the wires 5*a* and 5*b* to the auxiliary ribs 4' in FIG. 2*b,* and the wires 5*a,* 5*b,* 5*c* to the auxiliary ribs 4'' in FIG. 2*c.*

In the sectional view of FIG. 3 the anchoring means or device 6 is secured to the auxiliary rib 4 which in turn is secured to the net 2. The rib rests on the top surface of the net 2 and extends substantially perpendicularly to the plane of the drawing.

A plurality of adjustable anchoring devices are distributed along the length of each of the auxiliary ribs 4. Each of these adjustable anchoring devices 6 comprises an adjustable member 7, for example in the form of a hollow tubular sleeve 7 having a free outer end to which the bracing wires 5 are operatively connected as shown at 7'. The adjustable sleeve 7 is slidingly received in an adjustable manner in a fixed member 9 such as a hollow tubular member which in turn is secured to the respective auxiliary rib 4 so that the sleeve 7 is slidable up and down in the sleeve 9. The upper end of the sleeve 9 is rigidly secured to a socket 10' which in turn is part of or secured to a disc 10. The disc 10 rests against the bottom side of the antenna net 2 and is secured to the rib 4, for example, by rivets 17 which also hold a counter washer 17' resting against the upper or facing side of the net 2. The socket 10' extends through the net 2, through the rib 4, and through the counter washer 17'.

The adjustable sleeve 7 has in its sides two longitudinal guide grooves 18 extending in parallel to the longitudinal axis of the guide sleeve 7 and cooperating with two cams 19 at the inner upper end of the tubular member 9. The cams 19 engage in the grooves 18, thereby preventing the rotation of the sleeve 7 while simultaneously guiding the axial up and down movement of the sleeve 7 under the control of a threaded spindle 8 having a head 21 received in the socket 10' and rotatably held by a spring ring or locking washer 22. The outer free end of the adjustable slide sleeve 7 is provided with a threaded nut 20 in which the threaded spindle 8 is received. The threading of the spindle 8 and of the nut 20 is preferably of the self-locking kind. Except for a small play as permitted by the position of the locking washer 22, the spindle 8 is not axially movable. However, rotation of the spindle 8, for example, by inserting a tool into a respectively shaped recess 8' in the head 21 of the spindle 8, the sleeve 7 is axially adjustable up and down, whereby the wires 5 are tensioned. Such tensioning of the wires 5 in turn is transmitted to the reflector net 2 and to the respective auxiliary rib 4, whereby these ribs are pulled more or less into the down direction where the adjustment devices 6 are located. The adjustment direction of the net 2 and the rib 4 is indicated by the arrow A in FIG. 2*a*.

Figure 4:
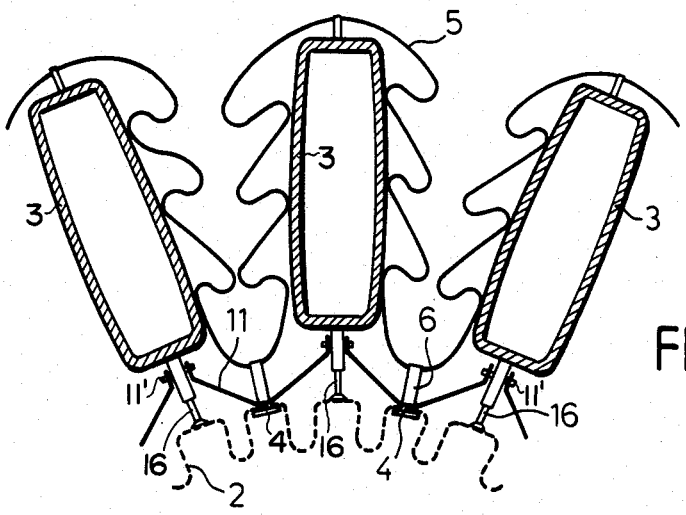
FIG. 4 shows a portion of a folded antenna reflector according to the invention substantially in the direction of the section plane 2*a*—2*a* in FIG. 1, wherein the auxiliary ribs are anchored to the carrier ribs by holding bails which are releasable when the antenna is to be unfolded.

FIG. 4 illustrates in a stylized manner a sectional view through three carrier ribs 3 in the folded state of the antenna in which the also folded reflector net 2 is forming the meandering shape between adjacent spacer members 16 secured to the ribs 3 and the auxiliary ribs 4. The anchoring devices 6 are rigidly secured to the spacer members 16 by holding bails 11 which are attached by releasable screws or clamps 11' to the spacers 16 in the folded condition. When the antenna is to be unfolded, the screws or clamps 11' are first released. On the other hand, when the antenna is to be folded and held in the folded condition the screws or clamps 11' are again tightened. In this manner it is possible to positively keep the antenna in the folded state during the starting and transporting phase of a satellite, for example. This feature of the invention has the advantage that the auxiliary ribs 4 and the adjustable anchoring means 6 assume a defined position during times when the antenna is exposed to vibrations and substantial loads. Thus, these screws or clamps 11' together with the bails 11 make sure that the adjustable anchoring devices 6 do not become entangled with the reflector net when the net is folded. The reflector net 2 is only free to fold in the relatively narrow areas between the ribs 4 and the adjacent spacer members 16. This feature of holding the net 2 in a relatively well defined position even in the folded state has the advantage that the net 2 is exposed during the starting phase only to the loads of its own mass. Contrary to this advantage, in a reflector having two nets, namely, the reflector net and the adjustment net, the reflector net is exposed during the starting accelerations to the load caused by the mass of the adjustment net and to the load caused by the mass of the tensioning wires and their respective adjustment elements. The invention avoids this loading of the net 2 during the starting phase because the bails 11 take up such loads as long as the net 2 is still in the folded state which is the case during starting of a satellite launching rocket.

Figure 5:
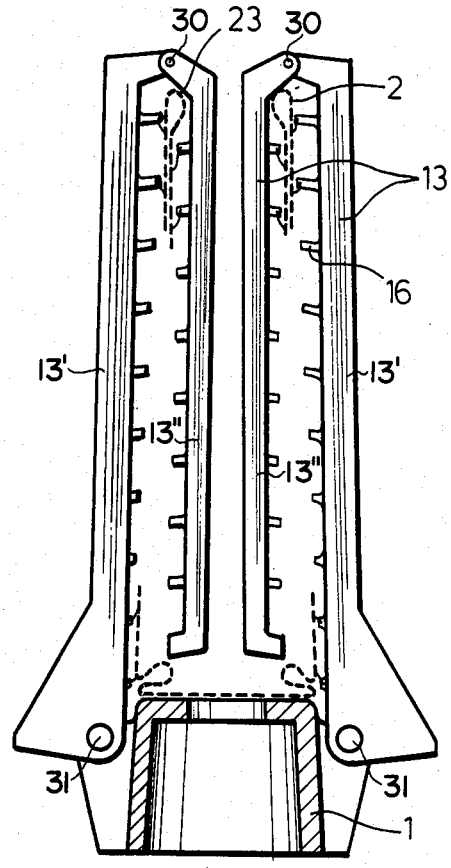
FIG. 5 is a view substantially in the same direction as defined by the section plane 1*b*—1*b* in FIG. 1*a,* however showing modified carrier ribs which are foldable back upon themselves.

FIG. 5 illustrates carrier ribs 13 which function in the same manner as the carrier ribs 3. However, each carrier rib 13 has at least two, or even more sections 13' and 13'' which are joined to each other by hinge means 30. As in FIG. 1*b*, the lower ends of the rib sections 13' are hinged to the hub 1 by hinges 31. Here again, the spacer members 16 are so positioned that their free ends define a parabolic curve against which the net 2 may rest. If desired, each individual spacer member 16 may be adjustable as is seen in FIG. 4 wherein a threaded stem of the spacer member reaches into a threaded hole of a socket secured to the respective rib 3. The auxiliary ribs 4 are not shown in FIG. 5 because they are located above and below the plane of the drawing. However, it will be appreciated that the auxiliary ribs 4 in FIG. 5 will also have a foldable joint at the locations 23. The net itself is sufficiently flexible for such folding.

Figure 6:
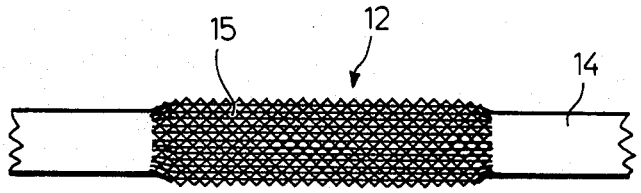
FIG. 6 shows on an enlarged scale an auxiliary rib for use in the embodiment of FIG. 5, whereby such auxiliary rib is provided with a hinging zone so that the auxiliary rib may also be folded back upon itself.

As shown in FIG. 6 the auxiliary ribs 4 may comprise rods 14 of fiber composite material provided with hinging zones 12 which will be located at the locations 23 in FIG. 5. These hinging zones 12 may, for example, comprise only the fibers 15 without the addition of the synthetic resin matrix material which is provided in the rods 14 outside the fibers 15 of the hinging zone 12.

Although the invention has been described with reference to specific example embodiments, it will be appreciated, that it is intended to cover all modifications and equivalents within the scope of the appended claims.

What is claimed is:

1. An unfoldable antenna reflector for a metallic antenna reflector net, comprising a central carrier body, a plurality of carrier ribs for carrying said reflector net, support means for pivotally securing one end of said carrier ribs to said carrier body so that said carrier ribs are movable between an open substantially radially extending position and a closed substantially axially extending position, a plurality of auxiliary ribs disconnected from said central carrier body and secured to said reflector net, said auxiliary ribs being located so that one or more auxiliary ribs are positioned between adjacent carrier ribs, flexible bracing wires for connecting said auxiliary ribs to said carrier ribs, securing means for operatively connecting one end of each bracing wire to an adjacent carrier rib, adjustable anchoring means operatively securing a respective auxiliary rib to the respective opposite end of a corresponding bracing wire, said bracing wires extending, in the unfolded state of said reflector net, in the direction of a resultant bracing tension force having two bracing tension force components one of which extends substantially perpendicularly to a plane defined by said reflector net in its unfolded state.

2. The antenna reflector of claim 1, wherein a plurality of said adjustable anchoring means are distributed along the length of the respective auxiliary ribs.

3. The antenna reflector of claim 1, wherein each of said adjustable anchoring means comprise an adjustable member (7) to which the respective bracing wire is operatively secured, and a fixed member (6) holding said adjustable member in an adjustable manner, said fixed member (6) being secured to the respective auxiliary rib, said adjustable member being movable substantially perpendicularly to said plane defined by said reflector net.

4. The antenna reflector of claim 3, wherein said adjustable member is a sleeve (7) slidably received in said fixed member in the form of a hollow tube (9), said adjustable anchoring means further comprising a threaded spindle (8), means rotatably securing said threaded spindle to said auxiliary rib (4), and a threaded nut rigidly secured to said sleeve (7), said threaded spindle (8) being received in said threaded nut for adjusting the position of said sleeve and thus the tension of the respective bracing wires operatively secured to said sleeve.

5. The antenna reflector of claim 4, wherein said securing means for said threaded spindle comprise a disk (10) secured to said respective auxiliary rib and a socket in said disk in which one end of said threaded spindle is rotatably held for said adjusting.

6. The antenna reflector of claim 1, further comprising holding bails (11) secured to said auxiliary ribs (4) and releasable connecting means for releasably securing said holding bails to said carrier ribs for holding said reflector net in a folded condition, said releasable connecting means being removable prior to unfolding said reflector net.

7. The antenna reflector of claim 1, wherein said carrier ribs comprise hinging means operatively interposed intermediate the ends of said carrier ribs for folding each carrier rib back upon itself, and wherein said auxiliary ribs comprise elastically flexible hinging zones in such positions intermediate the ends of said auxiliary ribs that the auxiliary ribs are also foldable together with the carrier ribs.

8. The antenna reflector of claim 1, wherein said auxiliary ribs are made of fiber composite material.

9. The antenna reflector of claim 8, wherein said composite material comprises aramide fibers.

10. The antenna reflector of claim 8, wherein said fiber composite material comprises carbon fibers.

11. The antenna reflector of claim 8, wherein said auxiliary ribs of fiber composite material comprise along their length elastically flexible hinging zones formed of fiber material without any embedding resin in said hinging zones, said hinging zones permitting folding said auxiliary ribs.

* * * * *